US005232470A

United States Patent [19]

Wiand

[11] Patent Number: 5,232,470

[45] Date of Patent: * Aug. 3, 1993

[54] FLEXIBLE ONE-PIECE DIAMOND SHEET MATERIAL WITH SPACED APART ABRASIVE PORTIONS

[76] Inventor: Ronald C. Wiand, 1494 Heatherwood, Troy, Mich. 48098

[ * ] Notice: The portion of the term of this patent subsequent to May 11, 2010 has been disclaimed.

[21] Appl. No.: 865,795

[22] Filed: Mar. 30, 1992

Related U.S. Application Data

[63] Continuation of Ser. No. 526,055, May 21, 1990, abandoned.

[51] Int. Cl.[5] ..... B24B 1/00

[52] U.S. Cl. ..... 51/295; 51/293; 51/298

[58] Field of Search ..... 51/293, 295, 298

[56] References Cited

U.S. PATENT DOCUMENTS

| | | | |
|---|---|---|---|
| 1,507,836 | 9/1924 | King | 51/398 |
| 2,907,146 | 10/1959 | Dyar | 51/195 |
| 3,048,482 | 8/1962 | Hurst | 51/298 |
| 4,078,340 | 3/1978 | Klecker et al. | 51/298 |
| 4,088,729 | 5/1978 | Sherman | 51/298 |
| 4,106,915 | 8/1978 | Kagawa et al. | 51/298 |
| 4,111,666 | 9/1978 | Kalbow | 51/298 |
| 4,554,765 | 11/1985 | Grimes et al. | 51/298 |
| 4,653,236 | 3/1987 | Grimes et al. | 51/298 |
| 4,750,915 | 6/1988 | Tomita et al. | 51/309 |
| 4,945,687 | 8/1990 | Scheider et al. | 51/298 |

FOREIGN PATENT DOCUMENTS

| | | |
|---|---|---|
| 619539 | 5/1961 | Canada . |
| 345239A1 | 12/1989 | European Pat. Off. . |
| 52-74990 | 6/1977 | Japan . |
| 106166 | 5/1917 | Netherlands . |
| 1827 | of 1862 | United Kingdom . |
| 2043501A | 10/1980 | United Kingdom . |

*Primary Examiner*—Mark L. Bell
*Assistant Examiner*—Willie J. Thompson
*Attorney, Agent, or Firm*—Harness, Dickey & Pierce

[57] ABSTRACT

A one-piece abrasive sheet and method of manufacture. The abrasive pad has a planar sheet portion with a plurality abrasive protrusion extending therefrom. The protrusions are intimately molded with the planar sheet portion to form a one-piece sheet. Thermoplastic and abrasive grit mixture may be used to form the sheet. The resulting pad has improved durability.

19 Claims, 1 Drawing Sheet

FLEXIBLE ONE-PIECE DIAMOND SHEET MATERIAL WITH SPACED APART ABRASIVE PORTIONS

This is a continuation U.S. patent application Ser. No. 526,055, filed May 21, 1990, now abandoned.

BACKGROUND OF THE INVENTION

The present invention relates to a flexible one-piece abrasive sheet. More particularly, the present invention relates to a flexible one-piece abrasive sheet which includes spaced apart abrasive portions which may be used as polishing pads and the like, and is particularly useful for polishing of marble and stone surfaces.

In the past, the use of abrasive pads which include abrasive resinoid segments attached to backing substrates, has been common when polishing stones and marbles and other materials. Because of the relatively thick and non-yielding resinoid segments generally used in this operation, it has been problematic to provide a flexible type abrasive pad using these types of segments. In the past, these segments have been attached to backing substrates, such as fabrics or the like, utilizing a large number of small segments to produce a flexible abrasive pad. Such abrasive pads are commonly used on rotary polishers for finishing of marble floor surfaces, for instance. While these structures have been useful as rotary polishing pads, the operational life of the pads has been low. This is because of disattachment of segments during use.

Therefore, it has been a goal in the art to produce a long lasting flexible "segmented-type" abrasive sheet material which will have increased durability and be less subject to loss of abrasive portions during use.

SUMMARY OF THE INVENTION

In accordance with the present invention there is provided a one-piece flexible abrasive sheet which may be in the form of a pad. The one-piece abrasive sheet includes a flexible planar sheet portion having a plurality of abrasive protrusions extending therefrom. The protrusions are intimately molded with a backing sheet from a thermoplastic material. The material includes an intimate mixture of an abrasive grit material.

The abrasive pad of the present invention provides a one-piece pad which increases the longevity of the pad during normal use, such as finishing of marble floors or flat edges and radius edges of counter tops, and reduces the amount of lost abrasive portions due to the integral molding of the portions with the substrate sheet.

Additional benefits and advantages of the present invention will become apparent from the subsequent description of the preferred embodiments and the appended claims taken in conjunction with the accompanying drawings.

DESCRIPTION OF THE PREFERRED EMBODIMENTS

Figure 1:
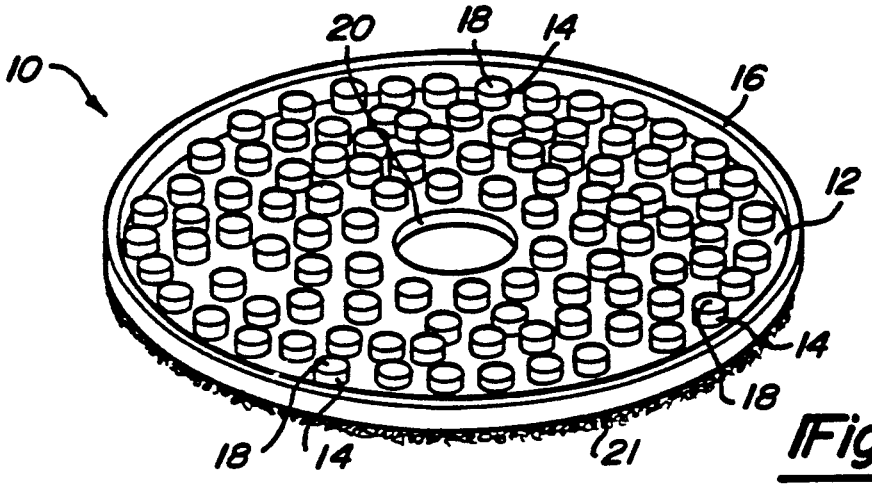
FIG. 1 is a perspective view of an abrasive pad made in accordance with the teachings of the present invention.

Referring now to the drawings, according to the present invention there is provided a flexible one-piece abrasive sheet, such as pad 10. The one-piece abrasive pad 10 includes flexible planar sheet portion 12 which has a plurality of abrasive protrusions 14 extending therefrom. The protrusions 14 are intimately molded with the sheet portion 12. For molding of these, a thermoplastic material, thermosetting material or other moldable and curable material is used which has an intimate mixture of an abrasive grit material therein.

In a preferred embodiment of the present invention, the pad 10 is formed in a circular embodiment with a peripheral lip portion 16 extending in the same direction as the protrusions 14. The lip portion 16 advantageously allows the pad to climb over obstacles in an irregular surface without damaging the abrasive protrusions 14. The advantage of the lip portion 16 is set forth in more detail in my co-pending U.S. patent application Ser. No. 502,056 Entitled "Marble, Granite and Stone Finishing Method and Abrasive Pads Therefor", filed Mar. 30, 1990, which is incorporated herein by reference thereto. The protrusions 14 have outer abrasive end surfaces 18 which are co-planar to one another. Preferably lip 16 is also co-planar to these peripheral edges 18. The pad 10 includes a central orifice 20 which is provided for fitting on a particular rotary tool to provide clearance during use. A means for attachment to a polishing tool, such as a velcro hook and loop fastener 21 is attached to the back of the pad 10. Such velcro attachments are common in the rotary tools used today. However, other means for attachment could readily be adapted as a particular tool required.

Figure 4:
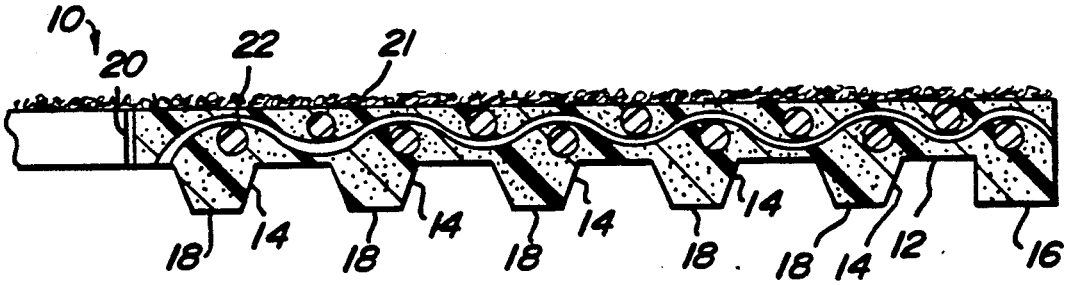
FIG. 4 is a sectional view of the abrasive pad of FIG. 1.

Referring now to FIG. 4, in a preferred embodiment a strengthening element 22 is integral with the backing portion 12. The strengthening element 22 may be any of a number of materials which have a plurality of apertures therethrough. A suitable strengthening element provides strengthening to the pad while retaining flexible characteristics of the backing portion 12 during use. In a preferred embodiment the strengthening element 22 is a woven mesh material such as a fiberglass mesh material, as shown in FIG. 4. In the embodiment shown in FIG. 4, the mesh material is embedded in the thermoplastic during the forming of the sheet portion 12.

Figure 3:
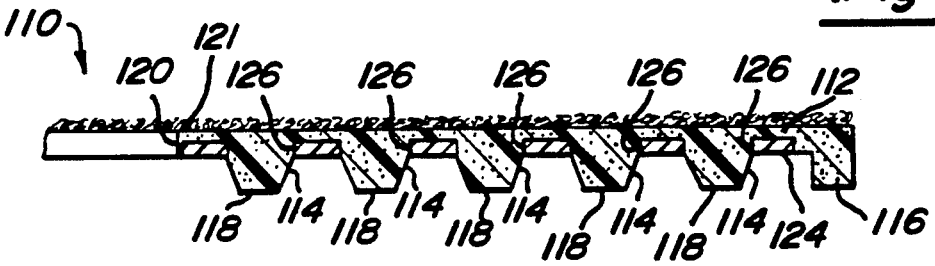
FIG. 3 is a sectional view of an alternate embodiment of an abrasive pad made in accordance with the teachings of the present invention.

Referring now to FIG. 3, there is shown an alternate embodiment of an abrasive pad, generally shown at 110. In the figures like numerals differing by 100 refer to like elements in the alternate embodiment 110. The alternate embodiment 110 is similar to the embodiment 10, however a perforated phenolic sheet material 124 is utilized as a strengthening element in place of the strengthening mesh 22. In this embodiment the thermoplastic is molded in-situ with the phenolic board such that the thermoplastic progresses through the perforations in the phenolic board material. The phenolic sheet material 124 is attached to the thermoplastic due to the compatible adhesive characteristics of the thermoplastic and the phenolic board and also due to the mechanical interlock of the protrusion 114 with the apertures 126 in the phenolic sheet material 124. A NEMA grade G-3 phenolic board, such as that utilized in circuit board applications, is a preferred material for this embodiment.

Preferably, the material used for forming the one-piece abrasive pad of the present invention is a thermosetting, thermoplastic or moldable polymer material which includes suitable abrasive particles interspersed therethrough. The material used must be sufficiently formable by melting or may have an initial liquid form, such that it may be forced to flow into and around the strengthening element. Suitable thermoplastic materials include polycarbonates, polypropylenes, nylons, polyurethanes, or other thermoplastics which can be thermomelted with heat and pressure to produce the abrasive pad 10 or 110. A preferred material is a polypropylene powdered material which may be mixed with diamond grit particles and/or silicon carbide type particles in its powdered form prior to the molding operation. Of course, other abrasive grit materials could be utilized in the present invention as will be readily appreciated by those skilled in the art.

In the past, it has generally been taught that thermoplastics are not generally useful in abrasive grit particles due to the heat and resulting decomposition and melting during use of such materials. However, in the present invention I have deviated from the prior art teachings by using thermoplastic materials which I have found to be suitable for such applications.

Figure 2:
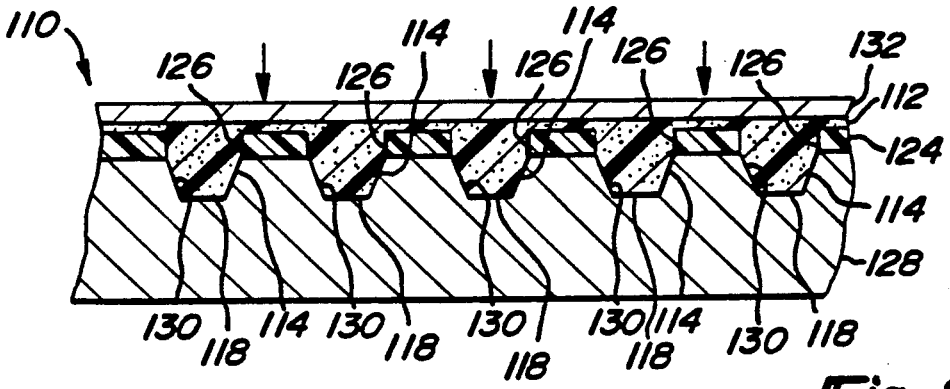
FIG. 2 is a sectional view illustrative of a process, in accordance with the teachings of the present invention, for manufacture of an abrasive pad.

Referring now to FIG. 2, in accordance with the method aspects of the present invention a lower mold platen 128 is provided which has a series of spaced indentation portions 130 corresponding to the shape of the desired protrusion in the resulting abrasive pad or sheet, such as sheet 110. An upper platen 132 is provided for placing a mixture of a thermoplastic material and an abrasive grit material under pressure, in the presence of heat, for forcing the thermoplastic and abrasive grit mixture into the indentations 130 of the mold platen 128. This forms the one-piece abrasive pad of the present invention.

Thus, in accordance with the steps of the present invention, it is first necessary to provide an intimate mixture of abrasive grit materials and a polymer material. This could be accomplished by mixing a powdered thermoplastic with an abrasive grit, by melt mixing these constituents, or by mixing the abrasive grit material in a liquid thermosetting polymer.

Thereafter, this mixture is placed in the mold platen 128 and the mixture is heated under pressure to form the resulting article 110 in the mold portion of the platen 128.

In a preferred embodiment, a strengthening element, such as the phenolic board material 124, is placed in the platen such that the orifices 126 are in the same locations as the indentations 130 of the platen 128. Thereafter, a mixture of a thermoplastic and abrasive material is placed on top of this. The platen 132 is then lowered on the above constituents in the presence of heat which thermoplastically deforms the plastic material with the abrasive grit intermixed therein and forces it through the orifices 126 and into the indentations 130 of the lower platen 128.

In an alternate embodiment, such as that shown in FIG. 4, the fiberglass or other mesh material, which is utilized as a strengthening element, may be placed on the platen 128 and thereafter the thermoplastic material is pressed through the apertures and the strengthening element to form the final abrasive pad or structure, as shown in FIG. 4.

Further understanding of the present invention may be obtained by reference to the following example which is given as further illustration of the present invention and is not to be construed to be limiting to the present invention.

EXAMPLE I 50 grams of polypropylene powder obtained from Himont Corporation of Troy, Michigan, product code number PC 072 PM, having a melt grade of 6 to 9, were mixed with 30 grams of a silicon carbide 600 grit abrasive material and 15 grams of a diamond 20/40 micron material. The powder and abrasive grit material were mixed and blended to form a congruous intermixed material.

A lower mold platen having a 3 ¼ inch diameter circular indentation with indentations therein for forming ⅛ inch diameter and 1/16 inch high projections and including mold portions for forming a lip ⅛ inch wide by 1/16 of an inch high was provided. A pin was provided at the center of the above mold which is ½ inch in diameter for performing the hole in the resulting abrasive pad.

13 grams of the above mixture was placed around the ½ inch pin into the bottom mold platen. On top of this a 20 mesh fiberglass material, formed 3 ¼ inches in diameter with a ½ inch center hole was placed. Thereafter, a suitable top platen was lowered on the above components and heated to 380° F. at 5 tons pressure for six minutes.

The abrasive grit and thermoplastic material melts and flows into the mold. The mold was released forming an abrasive pad with a lip portion, co-planar abrasive protrusions having abrasive grit material interspersed therein and a fiberglass reinforcement member embedded therein. The resulting pad was found to be suitable for floor polishing and edge polishing, railings, headstones, monuments and other marbles and the like.

While the above description constitutes the preferred embodiments of the present invention, it is to be appreciated that the invention is susceptible to modification, variations and change of departing from the proper scope and fair meaning of the accompanying claims.

What is claimed is:

1. A one-piece abrasive pad produced by molding a moldable polymer material comprising:

a flexible planar sheet portion having a plurality of abrasive protrusions arranged in a pre-selected pattern extending therefrom, said protrusions being intimately molded with said sheet portion from a single flexible moldable polymer material, said flexible moldable polymer material including an abrasive material homogeneously interspersed therethrough.

2. The one-piece abrasive pad of claim 1 wherein said protrusions have a co-planar abrasive surfaces.

3. The one-piece abrasive pad of claim 1 further comprising a strengthening element integrally molded within said sheet portion.

4. The one-piece abrasive pad of claim 1 further comprising a phenolic board backing material molded in-situ with said pad for providing a strengthening element for said sheet portion.

5. The one-piece abrasive pad of claim 1 wherein said material is a thermoplastic material.

6. The one-piece abrasive pad of claim 1 wherein said material is a thermosetting material.

7. A one-piece flexible abrasive sheet produced by molding of a moldable thermoset of thermoplastic polymer material comprising:

a flexible strengthening element including a plurality of apertures therethrough integrally moldable with a moldable thermoset of thermoplastic polymeric having an abrasive material interspersed therein for forming a backing sheet substrate, said backing sheet substrate including a plurality of intimately molded abrasive protrusions in a pre-selected pattern extending therefrom for forming a one-piece abrasive sheet, the outermost portions of said protrusions being substantially co-planar.

8. The abrasive sheet of claim 7 wherein said strengthening element is a perforated sheet.

9. The abrasive sheet of claim 8 wherein said perforated sheet is a phenolic board material.

10. The abrasive sheet of claim 7 wherein said strengthening element is a mesh material.

11. The abrasive sheet of claim 10 wherein said strengthening element is a fiberglass mesh material.

12. The abrasive sheet of claim 7 wherein the polymeric material is a thermoplastic.

13. The abrasive sheet of claim 7 wherein the polymer material is a thermosetting material.

14. A process of manufacture of an abrasive pad comprising the steps of:

a) providing a mold structure having a series of concavities for forming abrasive protrusions in a preselected pattern and an abrasive pad therein;

b) placing a flexible strengthening element having a plurality of apertures therethrough over said mold structure along with a mixture of a moldable thermoset or thermoplastic polymer material and an abrasive grit material; and c) forcing said mixture into and around said strengthening element and into said concavities for embedding said strengthening element in said polymer material and forming the abrasive sheet having intimately attached abrasive protrusions.

15. The process of claim 14 wherein said polymer material is a thermoplastic and the mixture is forced through the strengthening element by melting the thermoplastic and using pressure to force the melted thermoplastic into and around the strengthening element.

16. The process of claim 14 wherein said polymer material is a thermosetting material in a liquid form for forcing through said strengthening element and said concavities, and which may thereafter be cured for forming said pad.

17. The one-piece abrasive pad of claim 1 wherein said flexible moldable polymer material further comprises a thermoplastic selected from the group consisting of polycarbonates, polypropylenes, nylons and polyurethanes.

18. The one-piece abrasive pad of claim 7 wherein said flexible moldable polymer material further comprises a thermoplastic selected from the group consisting of polycarbonates, polypropylenes, nylons, and polyurethanes.

19. The process of manufacture of an abrasive sheet of claim 14 wherein the moldable thermoset or thermoplastic material is selected from the group consisting of polycarbonates, polypropylenes, nylons and polyurethanes.

* * * * *

UNITED STATES PATENT AND TRADEMARK OFFICE

CERTIFICATE OF CORRECTION

PATENT NO. : 5,232,470
DATED : August 3, 1993
INVENTOR(S) : Ronald C. Wiand

It is certified that error appears in the above-indentified patent and that said Letters Patent is hereby corrected as shown below:

Col. 2, line 34 "velcro" should be --Velcro®--

Col. 2, line 35 "velcro" should be --Velcro®--

Col. 4, line 40 "of" should be --without--

Col. 4, line 43, claim 1 after "molding" insert --of--

Col. 4, line 54, claim 2 after "have" delete "a"

Col. 5, line 3, claim 7 after "polymeric" insert --material--

Signed and Sealed this

Nineteenth Day of April, 1994

*Attest:*

Bruce Lehman

BRUCE LEHMAN

*Attesting Officer*

*Commissioner of Patents and Trademarks*